US006142910A

United States Patent [19]

Heuvelman

[11] Patent Number: 6,142,910

[45] Date of Patent: Nov. 7, 2000

[54] METHOD AND THERAPY SOFTWARE SYSTEM FOR PREVENTING COMPUTER OPERATOR INJURIES

[76] Inventor: John A. Heuvelman, 7951 N. Pl., Tucson, Ariz. 85741

[21] Appl. No.: 09/332,209

[22] Filed: Jun. 11, 1999

[51] Int. Cl.[7] ..... G01H 11/00

[52] U.S. Cl. ..... 482/4; 482/1; 601/33; 434/227; 434/229

[58] Field of Search ..... 482/1–4, 900; 434/227, 229; 601/33

[56] References Cited

U.S. PATENT DOCUMENTS 4,408,183 10/1983 Wills .
4,771,394 9/1988 Cavanagh .
4,779,865 10/1988 Lieberman et al. .
5,016,172 5/1991 Dessertine .
5,305,238 4/1994 Starr et al. ..... 702/176
5,308,296 5/1994 Eckstein .
5,362,069 11/1994 Hall-Tipping .
5,458,548 10/1995 Crossing et al. .
5,462,503 10/1995 Benjamin et al. .
5,466,213 11/1995 Hogan et al. .
5,478,295 12/1995 Fracchia .
5,792,025 8/1998 Kikinis ..... 482/1

*Primary Examiner*—Glenn E. Richman
*Attorney, Agent, or Firm*—Ellis, Venable & Busam, L.L.P.

[57] ABSTRACT

A method and therapy software system for preventing computer operator injuries combines a computer with a software system and prevents or rehabilitates computer operator injuries resulting from the prolonged use of a computer keyboard or mouse associated with the computer by reminding said computer operator to perform physical therapy exercises that are designed to reduce the potential injuries that can result from prolonged uninterrupted use of a computer keyboard or mouse.

12 Claims, 6 Drawing Sheets

METHOD AND THERAPY SOFTWARE SYSTEM FOR PREVENTING COMPUTER OPERATOR INJURIES

FIELD OF THE INVENTION

The present invention, a Method and Therapy Software System for Preventing Computer Operator Injuries, relates generally to a computer based system and software program for preventing computer operator injuries. More specifically, the present invention is a computer program that monitors a computer operator's mouse and keyboard activity to determine when a particular computer operator should perform user-specific, professionally developed therapeutical physical exercises. The invention temporarily transforms a computer system into an exercise machine by suspending ongoing computer operations in order to use the computer's audio and visual peripherals to present a digitally stored, animated audio/visual interactive presentation of therapeutic physical exercises. The data generated by the exercise sessions is subsequently recorded for administrative and medical review and may be used for managing employee health programs intended to reduce or even eliminate computer operator injuries.

BACKGROUND

The wide spread use of computer systems in the work place and at home has sparked a corresponding rise in physical injuries known generally as Repetitive Stress Injury ("RSI") or Occupational Overuse Syndrome ("OOS") and Cumulative Stress Syndrome; and Toxic Neck Reflex among computer users.

Typically, these injuries arise from a condition, which at the onset, is symptomatically little more than a minor irritation to a muscle(s) or joint(s). However, through the continued reuse of the afflicted area or through the continued repetition of the aggravating motion, the minor aggravation is transformed into a much more serious, sometimes debilitating condition. In extreme cases, the condition may require immobilization for extended periods or even surgery. In some cases, although infrequently, the subject of a chronic affliction is prevented from performing certain physical actions for the duration of their life.

While RSI injuries are traditionally associated with repetitive mechanical impact actions common within the working trades such as roofing, carpentry, floor laying carpeting (hammering, sawing, pounding) food processing (meat carving, deboning) or the automotive industry (single task jobs) it was recently determined that computer users likewise engage in physical actions which may cause similar if not identical injuries. Consequently, computer operators are now identified as a subject class for the RSI injuries once exclusively reserved for the working trades.

One of the most common RSI injuries sustained by computer users is identified as Carpal Tunnel Syndrome (CTS). CTS is frequently evidenced by a soreness which afflicts the wrist joint area. The medical profession believes that CTS is caused by inflammation and swelling which develops among the tendons running through a narrow channel in the wrist known as the Carpal Tunnel. The movement of the tendons through this area is often describes in layman terms "as ropes going across a pulley". When the tendons in this area become strained through continued impact, overuse, and strain inflammation and swelling develops which creates pressure or otherwise aggravates nerves running through the Carpal Tunnel. As the pressure causes the nerves to become sensitized the consequences to the person may vary significantly. Tenderness and stiffness of the wrist with pain radiating up along the forearm are the most common telltale signs of CTS. In some individuals these symptoms are understatedly mild when compared to the agonizing affliction which may develop.

In addition to the wrist area, medical research is also identifying RSI and CTS injuries with accompanying neurological and muscular dysfunction in other parts of the body. One area that appears particularly prone to injury is the neck and spine. Medical research has revealed that static pressure on the lower back which is caused by a computer operator sitting in one position for long periods of time can cause this type of injury.

The overall result is that CTS and RSI type injuries are taking an increasing toll on human as well as corporate resources. The rise of RSI type injuries in the work place and at home is generating a corresponding rise in medical costs rise with an inverse effect on personal and corporate productivity.

Worker compensation claims based upon injuries sustained in the office environment from computer usage are following this increase. This results in increased national corporate losses due to the corresponding decrease in worker productivity and increase in payment of insurance premiums, claims pay-out and other associated medical costs.

Recognizing that computer usage is a source of CTS and related injuries, the Federal Government through OSHA (Occupational Safety and Health Administration), has begun taking corrective action. Currently, OSHA is proposing voluntary rules regarding preventative steps that employers should post for employees to follow in order to minimize the causes of RSI in the work place. Among other proposed OSHA rulings is the institution of health care protocols for the prevention of RSI in computer operators. These protocols are based upon medical studies which have found that computer users that take a work break once every hour to perform 2–3 minutes of therapeutic exercises designed to stretch and relax those areas of the body prone to RSI will dramatically reduce the incidences of RSI. Thus, this device will function to assist an individual in preventing the rise of CTS and other RSI injuries. It will also assist company management to conform to government regulations regarding CTS and may well be a strategic tool in defending against potential lawsuits.

The related prior art does not offer any examples of software programs or computer systems which address CTS or the prevention of CTS in the workplace. Instead, the prior art reveals devices that are computer programs limited strictly to tracking the progress of health care exercises. In addition, the related prior art does not address a computer system which monitors a computer user's physical activity/condition through the computer keyboard and mouse. The prior art is similarly silent on programs or systems which will assist employers in defending against lawsuits and in proving compliance with governmental requirements. Additionally, the prior art does not contain evidence of software programs which use the computer's components to form an interactive physical exercise machine.

For example, the related prior art uses computer systems to monitor and tabulate a person's activity and physical condition when operating a stand alone exercise machine or other related devices which are separate from the actual operation of the computer by a user, includes: U.S. Pat. No. 4,7771,394, issued to Cavanagh utilizes a computer system with the user's operation of a pedometer; U.S. Pat. No.

4,779,865 issued to Lieberman et al uses a weight lifting exercise machine system; U.S. Pat. No. 5,308,296 issued to Eckstein using arm and legs exercise machine; U.S. Pat. No. 5,466,213 issued to Hogan et al uses a robotic arm for physical therapy; U.S. Pat. No. 5,016,172 issued to Dessertine monitors patient's medicine compliance; U.S. Pat. No. 5,362,069 issued to Hall-Tipping a exercise device coordinated with a video game; U.S. Pat. No. 4,408,183 issued to Wills uses a display device coordinated by computer with the usage of an exercise device; U.S. Pat. No. 5,478,295 issued to Fracchisa uses exercise machine coordinated with tabulation and training programs; U.S. Pat. No. 5,462,503 issued to Benjamin et al uses exercise machine coordinated with video displayed of an interactive simulated environment; U.S. Pat. No. 5,458,548 issued to Crossing et al uses a computer and exercise machine to establish the range of exercise training the user will operate the exercise machine.

The major disadvantage in the above inventions is that they are used to monitor and coordinate a person's interaction, not with a computer, but with devices external to a computer. These inventions neither monitor or coordinate the user's actual operation of the computer nor do they help alleviate the causes of any of physical aliments associated with the computer's usage.

The remaining prior art, which is in the field of exercise and physical therapy machines, does not address RSI and computer users. For example, U.S. Pat. No. 4,877,404 issued to Warren et al discloses a graphical interactive software training system that requires an interactive dialogue with the user to progress through the training course. This invention does not instruct the computer user to take action to alleviate causes of potential impairment to the computer operator's health caused by the operation of the computer.

Silverman et al (U.S. Pat. No. 4,571,682) concerns the development of computer programming architecture to allow a computer system to have greater capacity in analyzing physiological data. This invention does not use a computer to aid the computer user to avoid the causes of physical injuries which may arise from the operator's use of the computer.

Negishi (U.S. Pat. No. 4,894,777) is an information processing system that allows the computer system to monitor and improve a user's mental condition in relation to using the computer system. The computer utilizes visual and audio displays to increase the "user friendliness" of the system's interaction with the user so as to enhance the user's mental awareness during the use of the system. Based upon the input from a bio-sensor, one of the invention's displays will query the operator to determine if the operator is tired and would like to stretch. The invention does not make this inquiry to prevent injury to the user. The object of the invention is solely to improve the user's awareness during his or her use of the computer. The invention does not make the inquiry for the purpose of instituting physical therapy but rather uses the operator's stretching to maintain improved operator concentration and awareness during use of the computer.

As seen by the above analysis, the related prior art does not fulfill the need for a computer system that instructs the computer operator to take therapeutic actions needed to alleviate the causes of RSI.

SUMMARY OF THE INVENTION

This invention is a memory resident computer-based software program which is designed to operate on personal computer systems operating within the Microsoft Windows 3.11, Windows 95 and Windows 98 multi-tasking environment. While this computer system set up is the preferred embodiment, someone skilled in the art could apply the subject invention to numerous other computing or gaming platforms using various operating systems without altering the protectable elements claimed herein.

Upon the start or "boot-up" of a computer the invention is activated and placed into active memory. Once activated, the invention passively monitors a computer's keyboard and mouse input activity and compares it to a computer operator profile that is assigned to the current computer operator. When the computer user's keyboard and mouse activity reaches a criteria-level previously specified by an administrator, the invention suspends all ongoing computer functions. The invention then queries the operator to determine if the operator would need to participate in a professionally developed physical exercise regimen tailored to the particular computer operator's needs. If the operator elects to participate, the invention presents to the computer operator, via the computer's monitor and other peripherals, digitally recorded animated and still images which demonstrate to the operator a series of exercises which the operator is required to perform. As the series of exercises progresses, the invention interacts with the computer operator whereby the operator is required to enter data concerning the operator's participation in the exercise session.

At the operator's discretion, the invention can provide soothing digitized sound and visual images in accompaniment to the exercises. After the exercise program has concluded, the invention stores the generated data from the session for review by administrative personnel and restores the interrupted computer operations so that the operator may continue working. At this point, the invention returns to monitoring the computer operator's keyboard and mouse activity in order to determine when the next exercise session should be conducted.

The exercise program may also be initiated through the volition of the operator b the use of a previously determined sequence of keystrokes commonly referred to as a "Hotkey". The Hotkey allows computer operators to initiate an exercise program when desired without waiting for the control program to send an interrupt. These therapeutical exercises will occur as timed work breaks of short duration which is medically proven to be very beneficial in the prevention and alleviation of RSI symptoms.

The invention may be considered to contain four subprograms that work in cooperation to achieve the invention's purposes: the install/modify program, the administrative program, the control program and the main us er program. The install/modify program installs the invention onto the computer system. The administrative program permits the administrator in charge of the program to sculpt the invention to needs of the computer operators that will be utilizing the invention. The administrator program also provides the centralized point of reference from which the administrator may track and valuate the individual computer operator's participation and progress. The intent of the administrator program is to set up and modify how the invention runs for each computer operator. The main user program is the interface that the individual computer operators will interact with. The main user program will present the digitized exercises and sounds to the individual operators and will track their progress for later review by the system administrator using the invention's administrator program. The control program forms the "core" of the invention. It is this program that runs continuously in the multitasking environment. It is through the control program that the administrator and main user programs will be activated. The control program runs virtually unseen on the host computer's system but is responsible for managing the multi-tasking environment when it is activated.

It is an object of the invention to provide an informational analysis system that will alleviate the causes of work related RSI injuries in computer operators.

It is another object of the invention to provide an informational analysis system that will alleviate the causes of RSI injuries in home user computer operators.

It is still another object of the invention to provide an information analysis system which will reduce an employer's liability to OSHA and workers' compensation claims filed by employee computer operators suffering from work induced RSI injuries.

It is still another object of the present invention to provide an information analysis system that will demonstrate and instruct the operator of a computer system in performing physical therapy exercises that help reduce the incidences of RSI.

It is still another object of the present invention to provide an information analysis system that will notify the computer operator of the impending advent of the physical therapy exercise display.

It is still another object of the present invention to provide an information analysis system that limits the ability of the computer operator to input information while the invention is setting forth the demonstration and instruction of the exercises to the computer operator.

It is still another object of the present invention to provide an informational analysis system that limits the ability of the computer operator run other programs on the computer while the invention is setting forth the demonstrating and instruction of the exercises to the computer operator.

It is still another object of the present invention to provide an information analysis system that will cause an operator of the computer system to cease running programs operating in the computer operating system and perform physical therapy exercises.

It is still another object of this invention to provide an information analysis system that will use a computer generated digital life-like animation to demonstrate and instruct the computer user to do physical therapy exercises.

It is still another object of this invention to provide an information analysis system that utilizes several randomly selected sets of physical therapy exercises to help prevent the computer operator from being bored in doing the same set of exercises.

It is still another object of this invention to provide an information analysis system that utilizes several randomly selected sets of physical therapy exercises to help prevent the computer operator from being stricken with RSI that could occur if the computer operator performed the same exercises from cycle to cycle.

It is still another object of this invention to provide an information analysis system that uses a computer generated digital animation to provide greater and easier control of the visual presentation.

It is still another object of this invention to provide an information analysis system that uses a computer generated digital animation for the ease of creating new visual displays.

It is still another object of the present invention to provide an information analysis system that will use audio/visual presentation to relax the computer operator.

It is still another object of the present invention to provide an information analysis system that will provide the user with administrative control over various variables in the system.

It is still another object of the present invention to provide an information analysis system that will allow the user to adjust the variables in the invention without having to resort to rewriting the subprograms of the invention.

It is still another object of the present invention to provide an information analysis system that will record the invention's activity.

It is still another object of the present invention to provide an information analysis system that will provide maintain and create records of the invention's activity in a usable format that enables documenting compliance with OSHA regulations.

It is still another object of the present invention to provide an information analysis system that will provide maintain and create records of the invention's activity in a usable format for the user to use in providing a defense in Liability or worker compensation litigation.

It is still another object of the present invention to provide and information analysis system which will use computer keyboard and mouse input activity as a factor in determining when therapeutic exercises should be performed by the operator.

It is still another object of the present invention to provide an apparatus that will monitor a computer operator's operations.

It is still another object of the present invention to provide an apparatus for monitoring repetitive stresses that effect the physical condition of a computer operator.

It is still another object of the present invention to provide an apparatus for converting a computer system into a physical exercise apparatus.

It is still another object of the present invention to provide an apparatus for causing selection means to monitor for the repetitive stresses of a specific computer operator from those corresponding to a plurality of different operators stored in storage means and for causing output means to output information corresponding to the medical needs of the operator based upon the selected basic medical information.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DETAILED DESCRIPTION OF THE PREFERRED EMBODIMENTS

The present invention, a Method and Therapy Software System for Preventing Computer Operator Injuries, combines a computer 1 with a therapy software system 10 and is useful for preventing computer operator injuries resulting from the prolonged use of at least one Tactile Information Input Device 6 associated with said computer 1. More specifically, the present invention reduces computer operator injuries by reminding said computer operator to perform physical therapy exercises that are designed to reduce the potential injuries that can result from prolonged uninterrupted use of at least one Tactile Information Input Device 6.

The present invention is contemplated to be suitable for all computer controlled devices presenting the likelihood of injuries caused by the prolonged use of said Tactile Information Input Device 6. Ordinarily, said computer 1 will comprise of a common personal computing workstation, but it is further contemplated that the present invention will be adapted for use with other types of computing devices or platforms. For instance, the present invention would also be suitable for use with computer controlled industrial machinery that uses a knob or stick as a tactile information input device to control said computer controlled industrial machinery. Accordingly, in light of the Applicant's disclosure, it is considered within the knowledge of an ordinarily skilled practitioner to extend the inventive concept herein disclosed to other types of computing devices or platforms.

Figure 1:
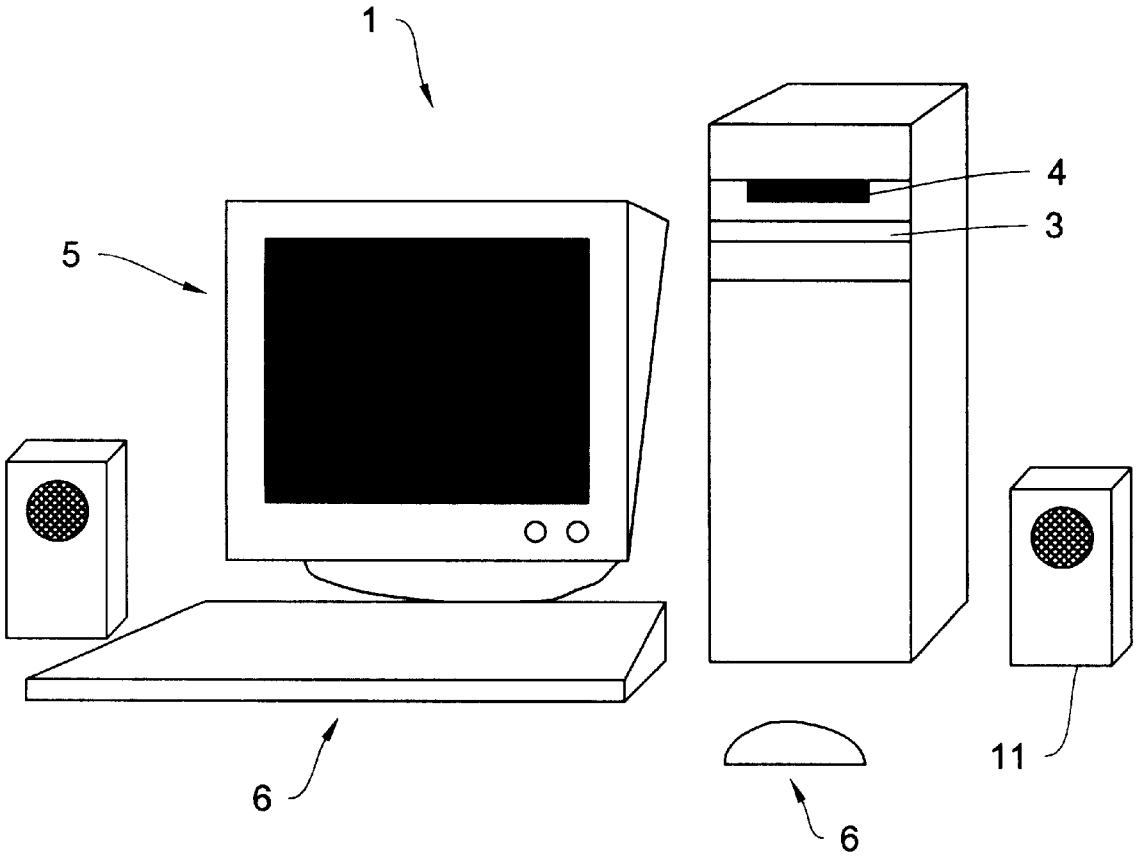
FIG. 1 depicts a desktop computer system.

The preferred computer 1 combined with the Therapy Software System 10 is a common personal computing workstation that has hardware that is ordinary in the art including. Said hardware includes; a Central Processing Unit ("CPU"); at least one type of computer memory including Random Access Memory ("RAM"); at least one Tactile Information Input Device ("TIID") 6 such as a hand operated computer mouse, a keyboard input device, a trackball, or a joystick; and at least one computer communication device includes a Video Display Device ("VDD") 5 and/or speakers 11. Moreover, said computer 1 will also use a multitasking operating system that manages the computer hardware and software resources and operates under a MS-DOS v.6®, or under a Windows 3.11®, Windows 95®, Windows NT®, or Windows 98®, Graphical User Interface ("GUI") environment. See FIG. 1. Alternatively, the Therapy Software System 10 is can also be coded in assembly language to enhance the Therapy Software System 10 performance.

Figure 2:
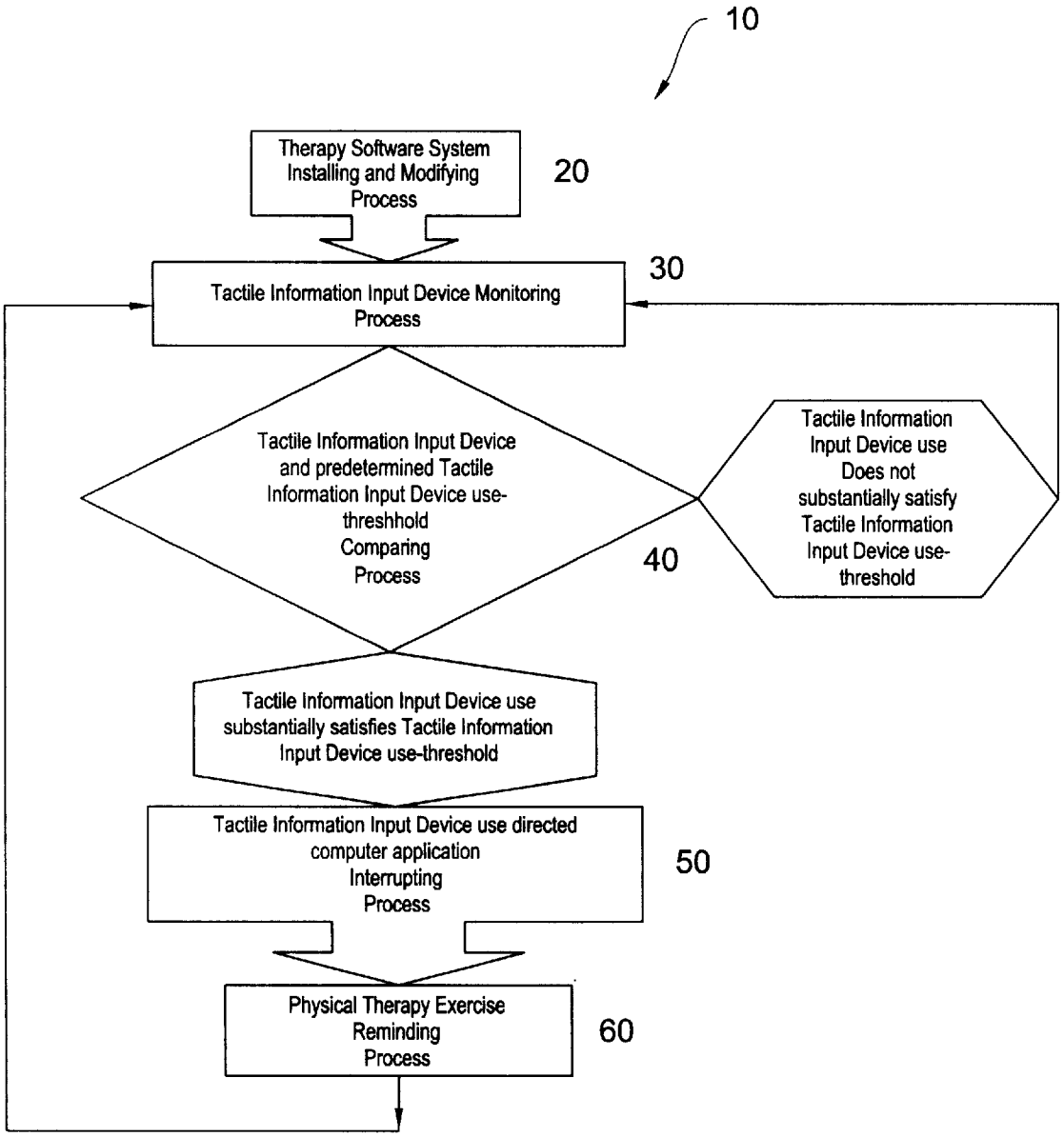
FIG. 2 is a general flow diagram depicting the Therapy Software System.

For any adaptation of the Therapy Software System 10 combined with said computer 1, said Therapy Software System 10 comprises several processes that implement the Therapy Software System 10. See FIG. 2. An installation and modification 20 process enables installing and modifying the Therapy Software System 10 in said computer memory. A monitoring process 30 tracks and records said computer user's use of said at least one TIID 6. A comparing process 40 receives the monitored TIID 6 use and compares said TIID 6 use to a predetermined TIID 6 use-threshold for substantial satisfaction of said TIID 6 use-threshold. The TIID 6 use-threshold is a computer administrator assigned parameter value corresponding to the TIID 6 use rate that will cause injury to the computer user and ultimately determines when the computer user will be interrupted and persuaded to perform a physical therapy exercise.

If the TIID 6 use substantially satisfies said predetermined TIID 6 use-threshold, an interrupting process 50 commands said multitasking operating syste m t o temporarily suspends processing of the computer user directed input from the at least one TIID 6 and commands said multitasking operating system to interrupt any computer user TIID 6 use directed application or CPU job. If on the other hand, the TIID 6 use does not substantially satisfy said predetermined TIID 6 use-threshold, said interrupting process 50 will not command said multitasking operating system to interrupt the computer user's use of said TIID 6. Finally, after suspending the input from said TIID 6, a reminding process 60 commands said operating system to remind said computer user to perform at least one physical therapy exercise.

The preferred embodiment of the Therapy Software System 10 comprises an Installation and Modification Program 200, an Administrator Program 250, a Control Program 400, and a Main User Program 600. The Installation and Modification Program 200 is a computer administrator directed process enabling installation of the Therapy Software System 10 on the computer 1. The Administrator Program 250 is a process that enables modifications to the general operating system parameters 251 and also to specific computer user specific operating parameters hereinafter referred to as a computer user profile 252. Said at least one computer user profile contains Therapy Software System 10 parameter settings that are specific to each computer user 252. The Control Program 400 is a process that operates continuously on the CPU upon each boot-up of the computer 1. Said Control Program 400 monitors, compares, and conditionally commands the operating system to interrupt any computer applications or jobs that are user directed through the use of said at least one TIID 6. The Main User Program 600 comprises processes that receive commands from the Control Program 400 and as a result, reminds the computer user to perform the at least one physical therapy exercise.

Figure 3:
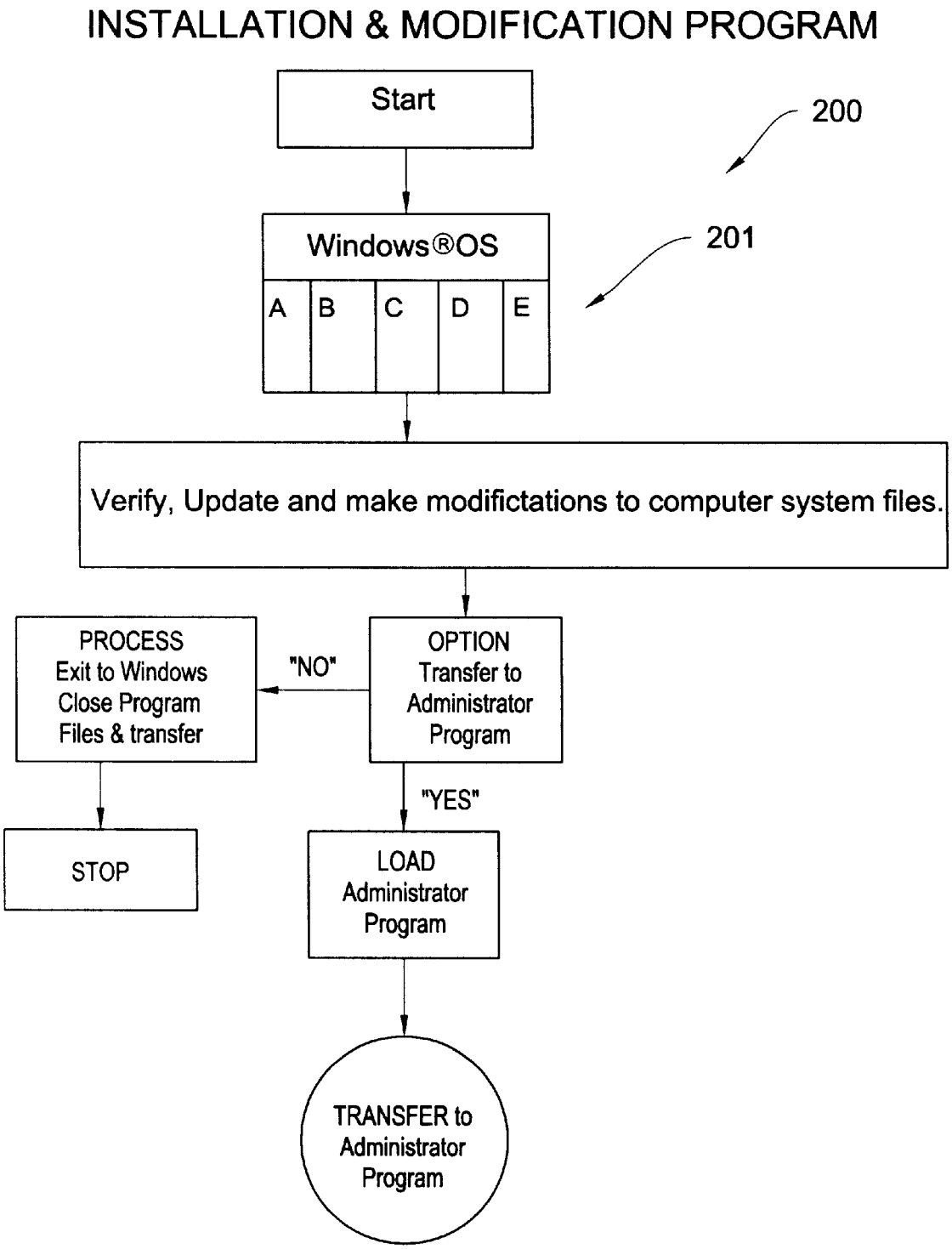
FIG. 3 depicts the Installation and Modification Program indicating the functional and logical elements needed to carry out the processing of data for the operation of the Install and Modify program of the invention that is the program that permits installation, setup and modification of the invention onto a computer system.

Referring to FIG. 3, the preferred Installation and Modification Program 200 is loaded into the computer memory by any manner ordinary in the art, such as by one or more CD-ROM disks that contain all of the executable files and passive data files that implement the Therapy Software System 10. The Installation and Modification Program 200 comprises a user directed executable file and is preferably initiated from the Windows® file manager 201. The Installation and Modification Program 200 first queries the computer user as to whether the user wishes to install the Therapy Software System 10. If the user elects to install the Therapy Software System 10, the Installation and Modification Program 200 copies the Therapy Software System 10 files necessary to implement the Therapy Software System 10 from the CD-ROM into computer memory. Otherwise, if the user elects not to install the Therapy Software System 10, the Installation and Modification Program 200 exits to the Windows® file manager 201. If the Therapy Software System 10 is installed, the files copied to the computer memory comprise passive data files and executable files. The passive data files are used by the Main User Program 600 and comprise platform compatible digital audio and visual exercise depictions. The executable files comprise the Administration Program 250, the Control Program 400, and the Main User Program 600.

After the passive data files and executable files have been copied into the computer memory, the Installation and Modification Program 200 passes control to the Administrator Program 250. The preferred Administrator Program 250 comprises subproceses for displaying automatically the Therapy Software System 10 credits and verifying entitlement to access to additional subprocesses. Said additional subprocesses comprise utilities that the computer administrator uses for modifying general system parameters 251 and each computer user profile 252, inspecting each computer user's TIID 6 use that is recorded by the Control Program 400, and disabling the Therapy Software System 10.

The general system parameters 251 and computer user profiles 252 are modified by the computer administrator to customize the Therapy Software System 10 operation for each computer user. The general system parameters 251 include the selection of secondary visual display, background music, exercise series and disabling the Therapy Software System 10. Options within the computer user profiles 252 include selecting a TIID 6 use-threshold, selecting audio and/or visual display exercise scripts, and options for disabling the selected background music and secondary visual display. The Main User Program 600 queries the general system parameters 251 and the options selected in the computer user profiles 252.

Figure 4:
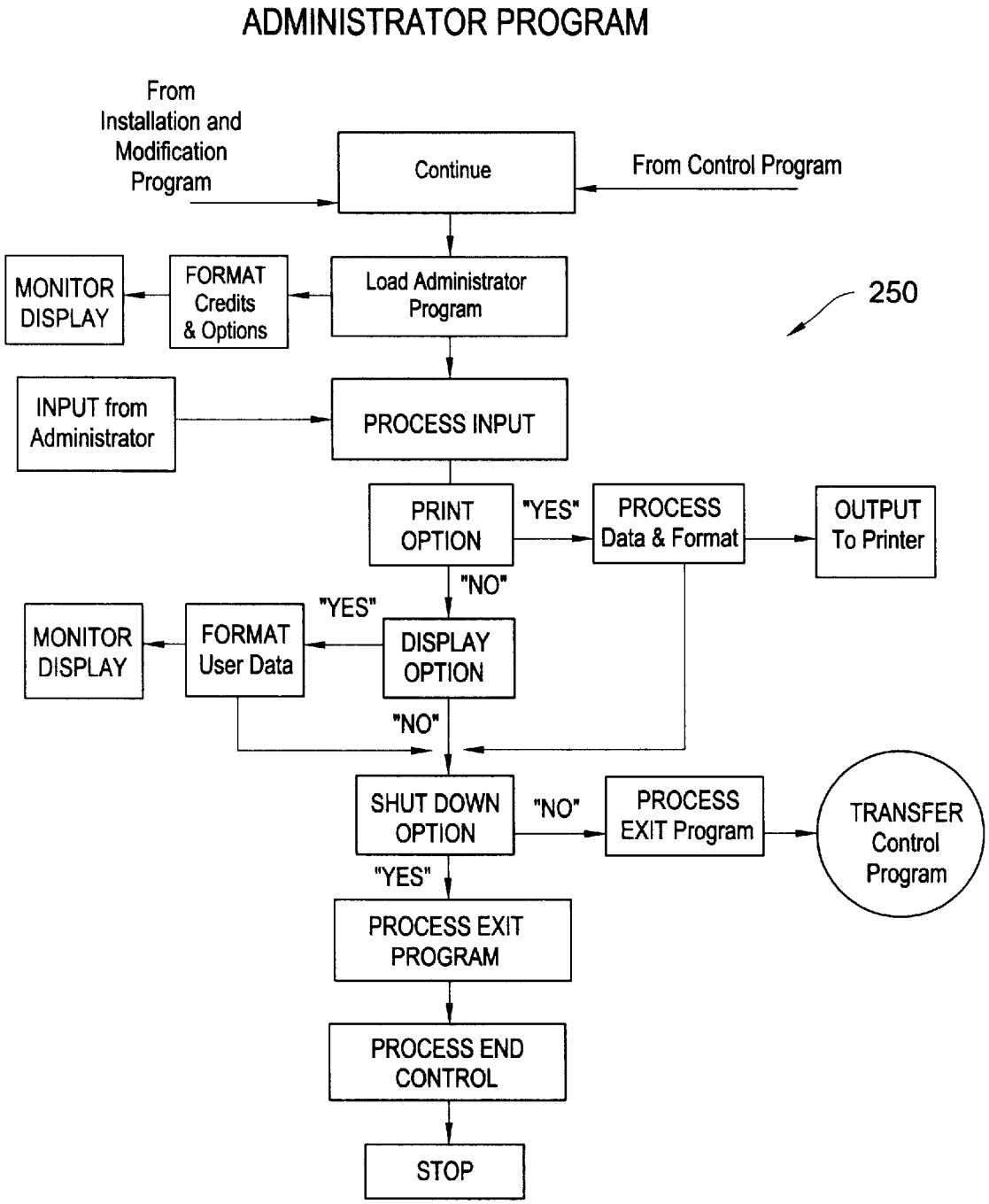
FIG. 4 depicts an overview of the flowchart for the Administrator Program indicating the functional and logical aspects for the dataprocessing operation of the Administrator Program of the invention which allows a system administrator to manage, configure and data analysis of the invention.

FIG. 4 depicts greater detail of the preferred Administrator Program 250. As Administrator Program 250 loads, it displays a screen depicting credits for the Therapy Software System 10. Next, the Administrator Program 250 requires system administrator to key in the correct administrator username and password to gain access to the modification functionality of the Administrator Program 250. If the correct administrator username and password are keyed in correctly, the Administrator Program 250 calls up the screen wherein the computer administrator can input the general system parameters 251 and modify each user profile 252.

The TIID 6 use-threshold is defined by the number of user directed TIID 6 acts within the time lapse for each computer user's TIID 6 use and is the threshold for when the particular computer operator will be reminded by the Main User Program 600 to perform at least one physical therapy exercise. The preferred TIID 6 use-threshold is that value that enables the Main User Program 600 to interrupt the computer user often enough to provide a therapeutically effective amount of exercise or therapy to prevent or rehabilitate operator injuries caused from prolonged TIID 6 use. The TIID 6 use-threshold can be modified for each individual computer user and is preferably dependant on a number of parameters including but not limited to, the likelihood of injury and the manual dexterity required for the computer user's TIID 6 use.

After modifying the general system parameters 251 and the computer user profile 251, the administrator may print or view the recorded computer user statistics log that is stored by the Administration Program 250. In the preferred embodiment, the Administration Program 250 queries the computer administrator as to whether a computer user's information should be print ed. A detailed depiction of this process is included in FIG. 4. After the administrator is finished modifying or viewing the recorded computer operator statistics, the administrator can select to exit the Administrator Program 250 and return to the Windows® GUI with the Control Program 400 running in the Windows® multitasking environment.

When the Therapy Software System 10 is installed on the computer 1, the Installation and Modification Program 200 modifies the computer 1 system files. The modifications enable the Control Program 400 of the Therapy Software System 10 to be automatically loaded into computer RAM and activated after each start or computer "boot-up". In a Windows® environment, this entails modifying the Windows® system files. The preferred Control Program 400 of the Therapy Software System 10 is written C++ and runs in 386 enhanced mode (multi-tasking) in the foreground of the Windows® environment.

Figure 5:
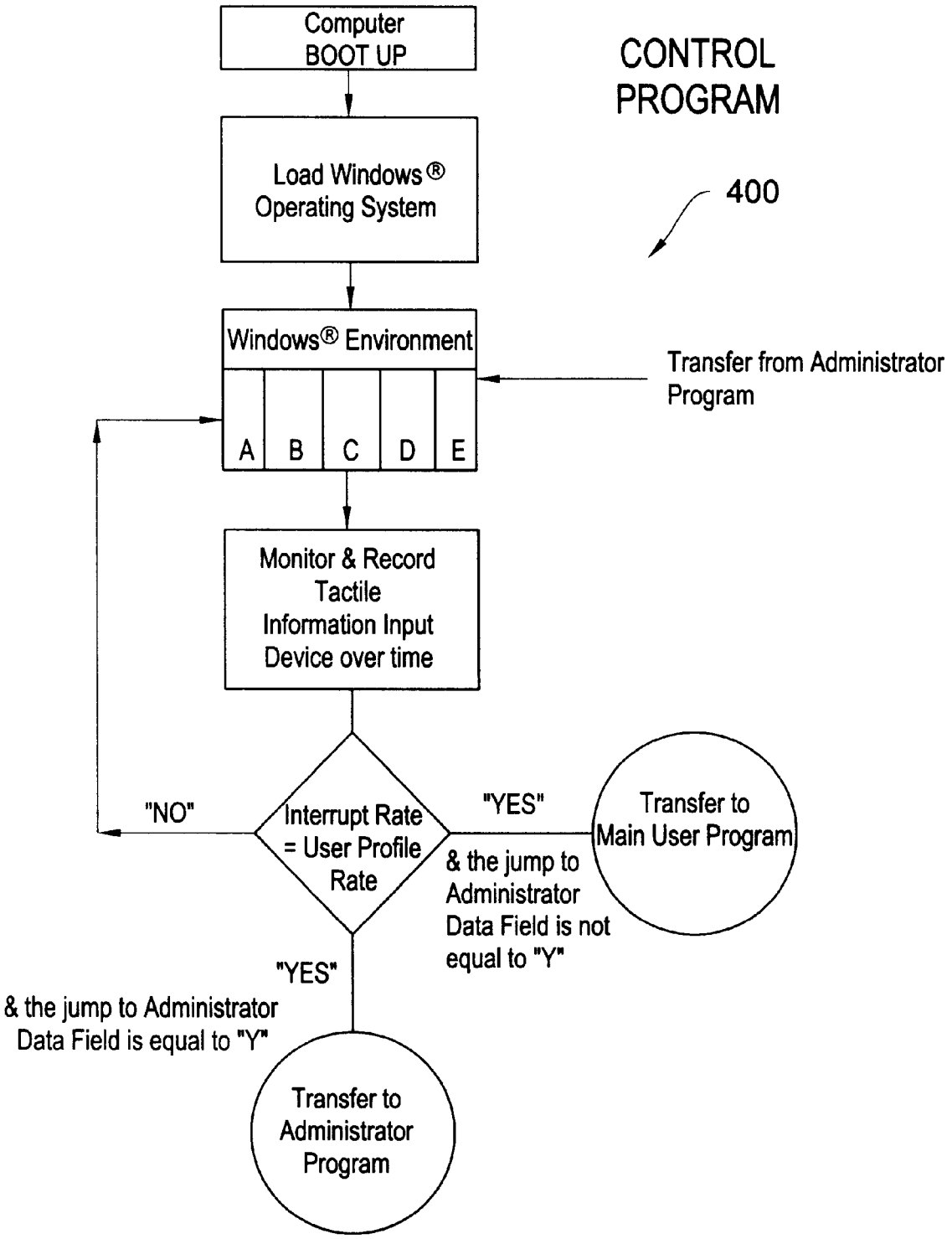
FIG. 5 depicts an overview of the flowchart for the Control Program indicating the functional and logical aspects for the dataprocessing of the Control Program which is responsible for interfacing with the operating system, initiating an interrupt, managing the other programs, calling up the user interface and recording information.

After computer 1 "boot up", the Control Program 400 commands the Windows® multi-tasking environment to assign the location of the Control Program 400 to "task A" within the Windows® multi-tasking environment. The Control Program 400 monitors and records the computer user's Tactile Information Input Device 6 use rate to determine when said TIID 6 use substantially satisfies the computer user's TIID 6 use-threshold as assigned by the computer administrator in the computer user profile 252. See FIG. 5.

If the TIID 6 use rate equals the TIID 6 use-threshold set by the administrator, the Control Program 400 commands the Windows® operating system to interrupt any computer application or job that is user directed through the use of said at least one TIID 6. Next, the Control Program 400 examines a jump to Administrator Program 250 data field set by the computer administrator. If this data field or "flag" is set to "Y" then the Control Program 400 calls up and executes the Administrator Program 250. Once the Administrator Program 250 is activated the Control Program 400 transfers control of the system to the Administrator Program 250. The data processing flow is then resumed under the Administrator Program 250.

If the Administrator data field or "flag" is not set to "Y" then the Control Program 400 accesses the computer memory and calls up the Main User Program 600. The computer operator is then queried as to whether the exercise program presented by the Main User Program 600 should be run immediately or delayed. If the computer operator chooses "Yes" then control is transferred to the Main User Program 600. If the computer operator selects "No" then transfer to the Main User Program 600 is temporarily delayed and the Control Program 400 resumes monitoring the keyboard and mouse activity. This process continues to cycle until the administrator using the Administrator Program 250 disables the Control Program 400 or the host computer 1 is turned off.

Figure 6:
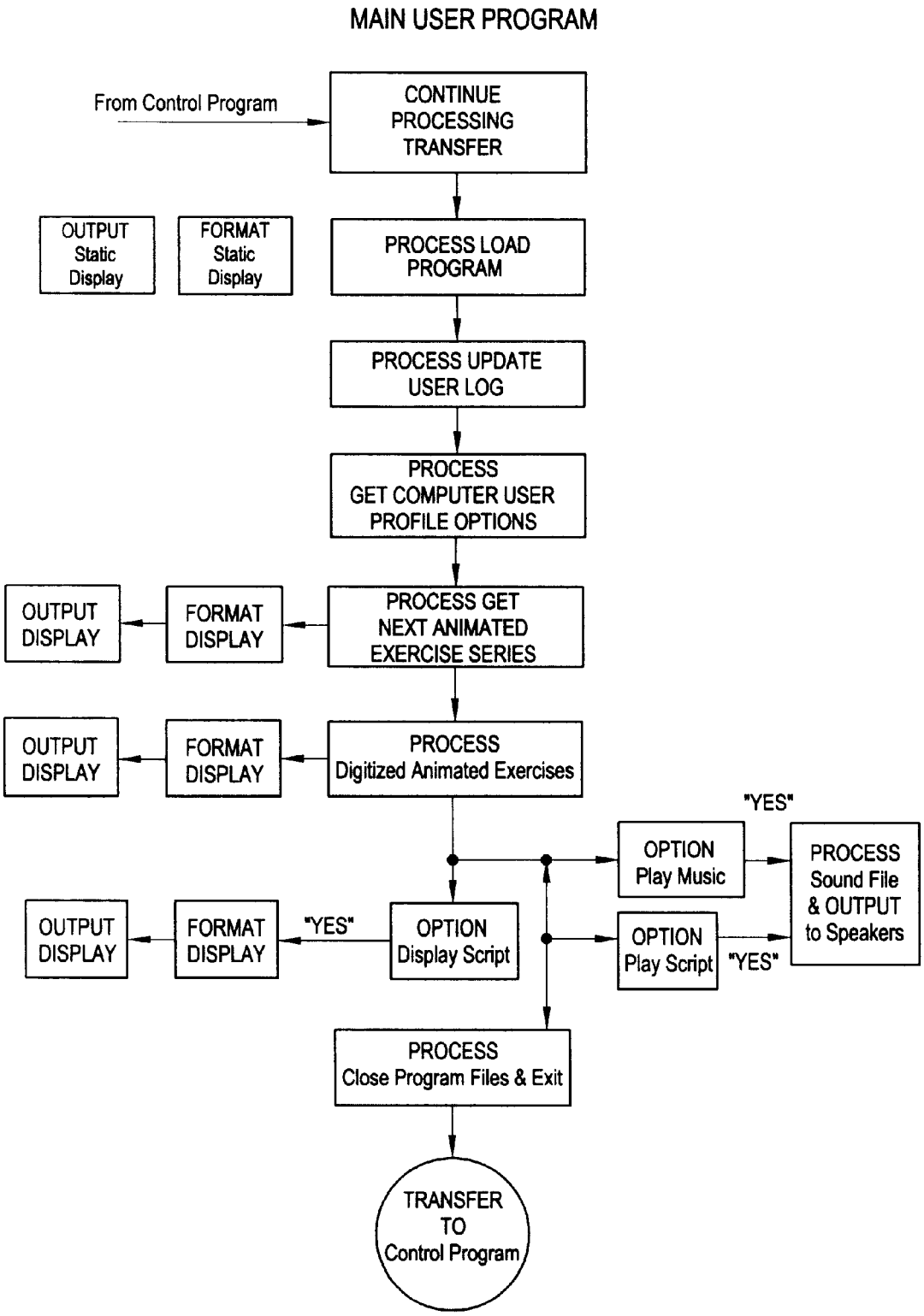
FIG. 6 depicts an overview of the Main User Program indicating the functional and logical elements needed to carry out the processing of data for the operation of the Main User Program of the invention which is the program that interfaces with the individual user and presents the therapeutic exercises.

Referring to FIG. 6, the Main User Program 600 loads as a function call from the Control Program 400 that transfers control to the Main User Program 600. The Main User Program 600 processes the transfer and loads files from the computer memory. The Main User Program 600 accesses passive data files that are formatted and sent to the VDD 5 for static display and viewing by the computer user. This static display is similar to that which appears during the Administrator Program 250. While the static display is presented, the Main User Program 600 continues to process the computer user log. The computer user log is updated to record when the Main -User Program 600 became active, the TIID 6 interruption threshold, the exercises selected and the status of the system. The Main User Program 600 then accesses the relevant computer user profile 251 and processes parameters previously set for the computer operator by the system administrator using the Administrator program 250. The Main User Program 600 then accesses the exercise animation series that corresponds to the selected computer user profile 251 and updates the computer user log. The invention then accesses and prepares for display the non-animated or still image.

As the non-animated image is displayed on the VDD 5 and the first series of animated exercises is prepared for display on the VDD 5, the Main User Program 600 accesses and prepares for display the next series of animated exercises. When the animation series is ready for display, the Main User Program 600 checks to determine if the option for playing a sound file of recorded music in computer platform compatible format has been selected. If the music selection is "YES" then the sound file is loaded, processed and outputted to the speakers 11. If the music option is "NO" then the invention determines if the script option has been elected. Next, the Main User Program 600 queries an audio script option and a visual text script option set by the computer administrator in the computer user profile 252.

If elected, the audio script option will enable the execution of a sound file that verbally describes animated exercises displayed on the VDD 5. Likewise, if the visual text script option is elected, text describing the animated exercises will be displayed on the VDD 5. Finally, the Main User Program 600 commands the Windows® operating system to display the animated exercise series to the VDD 5.

When the animated exercise series is completed, the computer user log is updated and the computer operator is prompted to signify compliance with the series. This prompt lasts for approximately 10 seconds and requires the computer operator to enter data by mouse and keyboard. Provided the computer operator affirmatively responds, the user log is updated and the Main User Program 600 begins to close its files and transfer control back to the Windows® GUI with the Control Program 400 operating as a concurrently operating task on the CPU of the computer 1.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A therapy software system for preventing repetitive stress injuries to a computer user; comprising:

a. a computer, said computer further comprising,
   i. at least one tactile information input device,
   ii. at least one communication device, the at least one tactile information input device and the at least one communication device coupled to said computer,
   iii. computer memory coupled to;
   iv. a central processing unit resident within said computer; and b. a computer software program existing in said computer memory and implementing an administrator directed therapy process, said process comprising the steps of,
   i. monitoring the user activity of at least one tactile information input device,
   ii. comparing when said at least one tactile information input device activity substantially satisfies a tactile information input device use-threshold,
   iii. interrupting the central processing unit of the computer from processing of only a computer job on said computer that is being directed by the tactile information input device,
   iv. communicating to said computer user via said at least one communication device to perform at least one physical therapy act; and
   v. administrating the software program with password protection thereby preventing unauthorized access to make modifications to, a plurality of computer user profiles and, at least one step selected from the group consisting of, the monitoring step, the comparing step, or the interrupting step, whereby said at least one physical therapy act reduces the potential for injury from prolonged use of said at least one tactile information input device.

2. An interactive computer software system which permits a computer operator to convert a computer system into a physical therapy exercise device providing the operator with a pre-selected audio-visual physical exercise course, comprising:

a. a host computer system including CPU for executing computer programs, means for entering data into the system, means for storing data, means for displaying the input data;

b. a processing means for performing various information processing operations in response to input from the computer operator;

c. a detecting means for detecting the computer operator's means for entering data into the system;

d. an interruption means for suspending said host computer system's ongoing activities to execute the said pre-selected audio-visual physical exercise course; and e. an auditory and graphic sub-system operatively connected to the host computer that is used to communicate said pre-selected physical exercise course to said computer operator, whereby said computer operator performs said physical exercise course to prevent or rehabilitate repetitive stress type injuries.

3. The therapy software system in claim 1 wherein the step administrating step further comprises the step of enabling the interrupting step.

4. The therapy software system in claim 1 wherein each of the computer user profiles includes identifying information for an individual computer user.

5. The therapy software system in claim 1 wherein each of the computer user profiles includes an use-threshold parameter for an individual computer user.

6. The therapy software system in claim 4 wherein each of the computer user profiles includes a log of user therapy accessible by way of the step of administering with a password.

7. The therapy software system in claim 1 wherein the step of communicating to said computer user further includes the step of displaying a series of animated and still pictures communicated by auditory and graphic sub-system, said pictures providing a course of exercise in response to operator input data and interacting with the operator as operator advances through said pre-selected course, said pictures also accompanied by verbal and written instruction.

8. A Computer software program for installation on a computer having a central processing unit, comprising:

a. means for installing and customizing the software program to accommodate multiple computer architectures;

b. means for monitoring a computer user's user of at least one tactile information input device;

c. means for interrupting a central processing unit on which the software program is installed and running;

d. means for providing password protected administration of a prescribed course of physical therapy to a plurality of individual computer users and of enabling the means for interrupting a central processing unit; and e. means for communicating the prescribed course of therapy to the plurality of individual computer users.

9. The computer program in claim 8 wherein the means for monitoring and the means for interrupting are implemented with a control program that is a constantly running task the on central processing unit and the means for communicating is implemented with a separate main user program that is only executed when called by the control program.

10. The computer program in claim 8 wherein the means for providing password protected administration of the course of physical therapy further comprises means for compiling and displaying statistics compiled for user conformance with the course of therapy.

11. The computer program in claim 8 wherein the means for communicating the prescribed course of therapy further comprises a main user program that displays a still image on a computer screen while animated exercises are loaded from a nonvolatile computer memory into a volatile computer memory.

12. The computer program in claim 8 wherein the means for communicating the prescribed course of therapy further comprises a main user program that queries at least one of the plurality of computer user profiles to determine the prescribed course of physical therapy for that computer user.

* * * * *